US007604318B2

(12) United States Patent
Umeda

(10) Patent No.: US 7,604,318 B2
(45) Date of Patent: Oct. 20, 2009

(54) INK-JET RECORDING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 40 days.

(21) Appl. No.: 11/460,523

(22) Filed: Jul. 27, 2006

(65) Prior Publication Data

US 2007/0024654 A1 Feb. 1, 2007

(30) Foreign Application Priority Data

Jul. 27, 2005 (JP) ..... 2005-217698

(51) Int. Cl.
*B41J 29/393* (2006.01)

(52) U.S. Cl. ..... 347/19

(58) Field of Classification Search ..... 347/12, 347/15, 19, 30, 33
See application file for complete search history.

(56) References Cited

U.S. PATENT DOCUMENTS

| | | | | |
|---|---|---|---|---|
| 5,581,284 | A | 12/1996 | Hermanson | |
| 5,960,161 | A | 9/1999 | Bloomberg et al. | |
| 6,786,568 | B2 | 9/2004 | Greive | |
| 7,217,315 | B2 * | 5/2007 | Bauer et al. | 106/31.6 |
| 2003/0210309 | A1 * | 11/2003 | Kimura et al. | 347/85 |
| 2005/0035995 | A1 | 2/2005 | Yazawa et al. | |

FOREIGN PATENT DOCUMENTS

| | | |
|---|---|---|
| EP | 20000983855 | 8/2000 |
| JP | H8207321 | 8/1996 |
| JP | H10285422 | 10/1998 |
| JP | 200071432 | 3/2000 |
| JP | 200196772 | 4/2001 |
| JP | 2002254672 | 9/2002 |
| JP | 2003118149 | 4/2003 |
| JP | 2003276186 | 9/2003 |
| JP | 2004174816 | 6/2004 |
| JP | 200559363 | 3/2005 |

* cited by examiner

*Primary Examiner*—Lamson D Nguyen
(74) *Attorney, Agent, or Firm*—Baker Botts L.L.P.

(57) ABSTRACT

An ink-jet recording apparatus is provided which promptly resumes image recording in the case of non-ejection of ink from an ejection nozzle(s) of a recording head. The ink-jet recording apparatus includes sub-tanks and a recording head with a plurality of ejection nozzle groups composed of ejection nozzles. The recording head selectively ejects ink inside the sub-tanks to perform image recording. The ink-jet recording apparatus further includes an image recording control device that selects at least one of the plurality of ejection nozzle groups for image recording, and a non-ejection status detection device that detects whether there is any ejection nozzle in a non-ejection state. When the non-ejection status detection device detects one or more ejection nozzles in a non-ejection state, the image recording control device selects one out of the plurality of ejection nozzle groups that is without any of the ejection nozzle(s) in a non-ejection state for image recording.

14 Claims, 17 Drawing Sheets

EJECTION STATE
CONDUCTION - OFF

STANDBY STATE
CONDUCTION - OFF

INK-JET RECORDING APPARATUS

CROSS-REFERENCE TO RELATED APPLICATIONS

This application claims the benefit of Japanese Patent Application No. 2005-217698 filed Jul. 27, 2005 in the Japan Patent Office, the disclosure of which is incorporated herein by reference.

BACKGROUND

This invention relates to a technique for prompt recovery of image recording in an ink-jet recording apparatus even when there is non-ejection of ink from an ejection nozzle of a recording head.

Conventional ink-jet recording apparatus are known to be provided with an ink supply system. That is, an ink-jet recording apparatus of this type includes a carriage that mounts a recording head which ejects ink from ejection nozzles to perform recording on a recording medium, and main tanks that store ink to be supplied to sub-tanks provided on the recording head. When there is a decrease in the ink in the sub-tanks, ink is supplied from the main tanks to the sub-tanks.

Such an ink-jet recording apparatus performs recovery operation in the case of non-ejection of ink from an ejection nozzle of the recording head.

Unexamined Japanese Patent Publication No. 10-285422, for example, discloses an ink-jet recording apparatus as above that includes two separate ejection nozzle groups in a recording head and allows the image recording either in a normal image quality mode or in a high image quality mode. One of the two ejection nozzle groups corresponds to a BCMY color system, and the other corresponds to a RGB color system.

SUMMARY

However, in the aforementioned ink-jet recording apparatus, image recording must be suspended in order to perform recovery operation in the case of non-ejection of ink from an ejection nozzle of the recording head. Accordingly, there is a problem that the user is kept waiting as much until the image recording is completed.

The present invention is made to solve the above problems. It would be desirable to provide a technique of promptly resuming image recording in an ink-jet recording apparatus even when there is non-ejection of ink from an ejection nozzle of a recording head.

It is desirable that an ink-jet recording apparatus of the present invention is provided with sub-tanks storing ink and a recording head that includes a plurality of ejection nozzle groups composed of a plurality of ejection nozzles. The recording head selectively ejects the ink inside the sub-tanks to perform image recording on a recording medium. The ink-jet recording apparatus is further provided with an image recording control device that selects at least one of the plurality of ejection nozzle groups to perform image recording, and a non-ejection status detection device that detects whether there is any ejection nozzle in a non-ejection state. When the non-ejection status detection device detects one or more ejection nozzles in a non-ejection state, the image recording control device selects one without any of the ejection nozzle(s) in a non-ejection state, out of the plurality of ejection nozzle groups for image recording.

According to the ink-jet recording apparatus of the present invention, when one or more ejection nozzles are found to be in a non-ejection state, one without any of the ejection nozzle (s) in a non-ejection state is selected out of the plurality of ejection nozzle groups for image recording. Therefore, even in the case of non-ejection of ink in the ejection nozzle(s) of the recording head, image recording can be quickly resumed without recovery operation, for example.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

A multi function device (MFD) 10 integrally includes a printer portion 11 at a lower part and a scanner portion 12 at an upper part. The multi function apparatus 10 serves as a printer, a scanner, and a copier. Those functions other than a printer function may be omitted. Accordingly, the present invention may be applied to a single function printer without the scanner portion 12, i.e., without a scanner function and a copying function, or may be applied to a multi function device that further includes a communication portion, i.e., a facsimile function.

The present invention may be applied to a small-sized apparatus like the multi function apparatus 10 of the present embodiment, or a large-scaled apparatus having a number of sheet cassettes and an auto document feeder (ADF). The multi function apparatus 10 may be connected to a not shown computer so that images and documents can be recorded on recording sheets based on image data and document data transmitted from the computer. Moreover, the multi function apparatus 10 may be connected to a digital camera so as to record image data outputted from the digital camera on recording sheets, or may have other various storage media inserted therein so as to record image data and the like stored on the storage media on recording sheets.

As later explained in detail, one of the features of the multi function apparatus 10 of the present embodiment is to generate multiple colors of ink mixed inside the multi function apparatus 10 by storing only a few colors of ink (basic color inks) in advance. This allows multiple colors of ink to be used in forming an image, so that color reproducibility is improved in the multi function apparatus 10. Furthermore, since only a small number of basic color inks are stored in advance, no significant increase in running costs occurs in the multi function apparatus 10.

Figure 1:
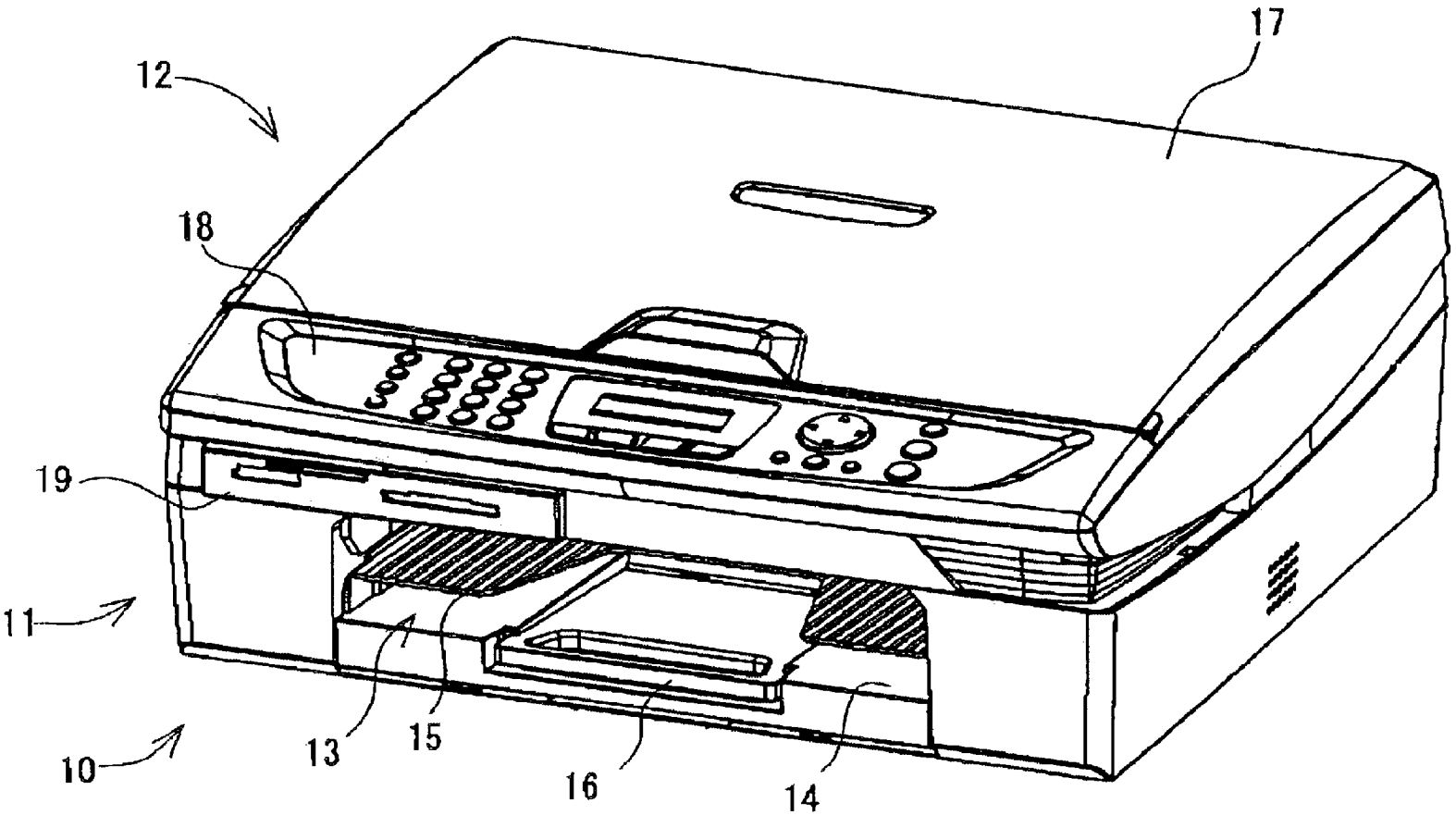
FIG. 1 is an external perspective view of a multi function apparatus (ink-jet recording apparatus) suitable for application of the present invention.

Referring to FIG. 1, the multi function apparatus 10 has an outer shape of a substantially broad, thin rectangular parallelepiped. The width and depth of the multi function apparatus 10 are set larger than its height. The printer portion 11, provided at the lower part of the multi function apparatus 10, has an opening 13 at the front. A feed tray 14 and a catch tray 15 arranged in two tiers protrude from the opening 13. The feed tray 14 is designed to store recording sheets of various sizes not larger than A4 size, including a B5 size and a post card size. The feed tray 14 is provided with a slide tray 16 which can slide outward so as to expand a tray surface as required. A recording sheet stored in the feed tray 14 is fed into the printer portion 11. The recording sheet is discharged to the catch tray 15 after a predetermined image is recorded thereon.

The scanner portion 12, provided at the upper part of the multi function apparatus 10, is designed as a so-called flat head scanner. A cover 17 is attached to the multi function apparatus 10 in a manner capable of being freely opened and closed. The cover 17 serves as a top board of the multi function apparatus 10. A platen glass and an image reading carriage (neither shown) are provided below the cover 17. The platen glass is for setting a document thereon. The image reading carriage provided below the platen glass can slide in a main scanning direction (width direction of the multi function apparatus 10). The image reading carriage reads a document while sliding in the width direction of the multi function apparatus 10.

An operation panel 18 is provided on the front side at an upper part of the multi function apparatus 10. The operation panel 18 is for operation of the printer portion 11 and the scanner portion 12. The operation panel 18 includes various operation buttons and a liquid crystal display. The multi function apparatus 10 operates according to instructions received through the operation of the operation panel 18, or instructions received from a computer via a printer driver. A slot portion 19 is provided on the front side at an upper left part of the multi function apparatus 10. Various small-sized memory cards as the storage media can be inserted to the slot portion 19. Image data stored on a small-sized memory card are displayed on the liquid crystal display. Through the operation of the operation panel 18, predetermined images stored on the small-sized memory cards are recorded onto recording sheets by the printer portion 11.

Figure 2:
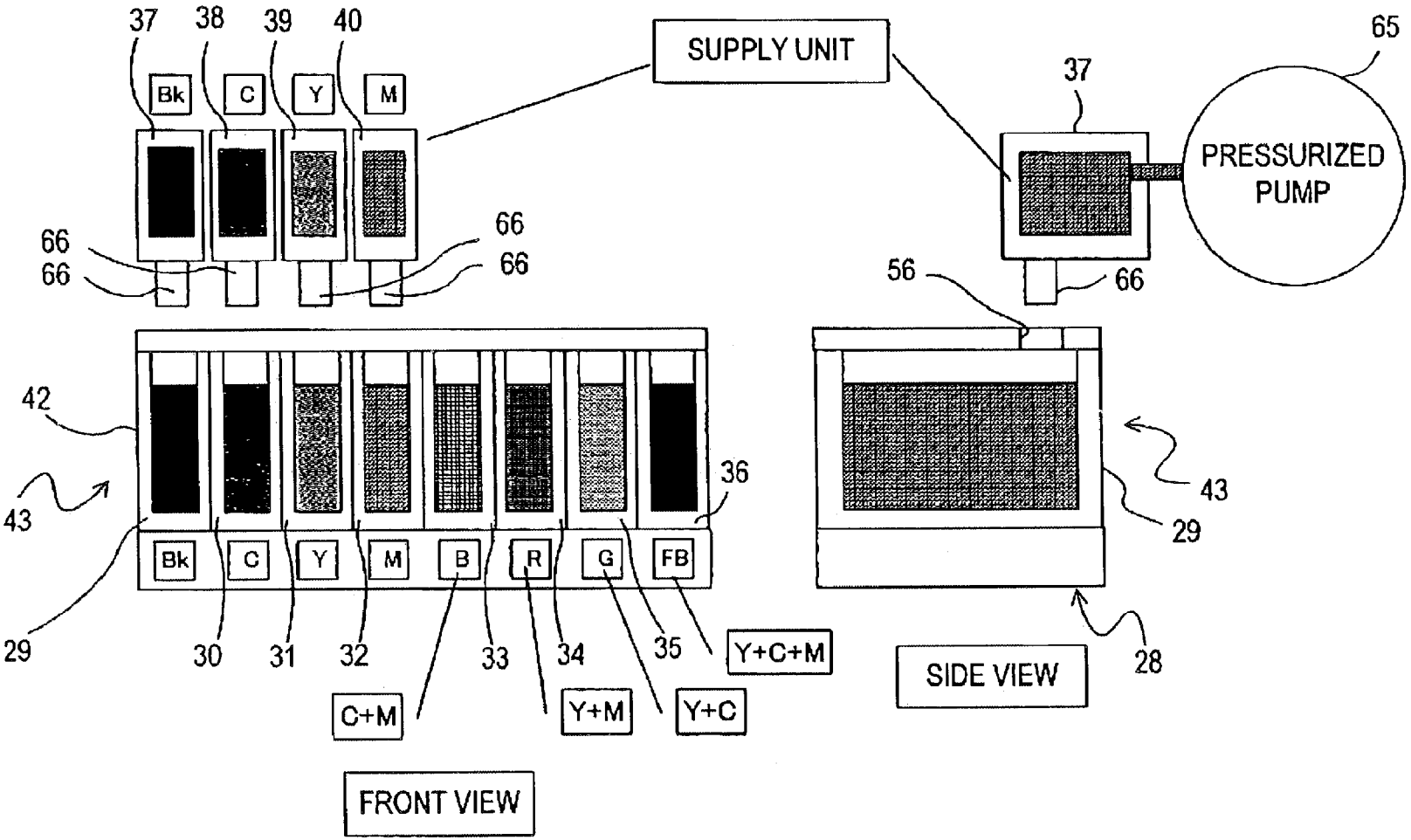
FIG. 2 is an explanatory diagram showing a head portion and ink tanks.

Referring to FIG. 2, the multi function apparatus 10 is provided with a head portion 28, a platen (not shown) disposed opposite to the head portion 28, and ink tanks 37 to 40 of a cartridge type which supply ink to later explained sub-tanks 29 to 36.

The head portion 28 is provided with a recording head 43, the sub-tanks 29 to 36 which supply ink to the recording head 43 (ink-jet recording head), and a scanning carriage (not shown) which can slide in a main scanning direction by a driving force of a not shown driving portion.

The sub-tanks 29 to 36 are disposed at even intervals. From the left side of the multi function apparatus 10, black (Bk) ink, cyan (C) ink, yellow (Y) ink, magenta (M) ink, blue (B) ink, red (R) ink, green (G) ink, and photo black (Fb) ink are stored in the respective sub-tanks 29 to 36. The sub-tanks 29 to 32 constitute one sub-tank group and the sub-tanks 33 to 36 constitute the other sub-tank group.

The sub-tanks 29 to 36 have an engaging portion 56 on its upper part, respectively. Each engaging portion 56 is formed to face with a connecting portion 66 of the respective ink tanks 37 to 40. When the lowered connecting portion 66 communicates with the engaging portion 56, ink can be supplied from either of the ink tanks 37 to 40 to one of the sub-tanks 29 to 36.

The ink tanks 37 to 40 are equally spaced apart. The ink tanks 37 to 40 store, from the left side of the multi function apparatus 10, black (Bk) ink, cyan (C) ink, yellow (Y) ink, and magenta (M) ink, respectively. The ink tanks 37 to 40 are not necessarily of a cartridge type. Any type will do as long as they can store ink. A pressurized pump 65 is connected to each of the ink tanks 37 to 40.

The head portion 28 configured as above slides in a main scanning direction while ejecting inks of respective colors such as cyan (C), magenta (M), yellow (Y), and black (Bk) supplied from the ink tanks 37 to 40 so as to record an image on a recording sheet.

Figure 3:
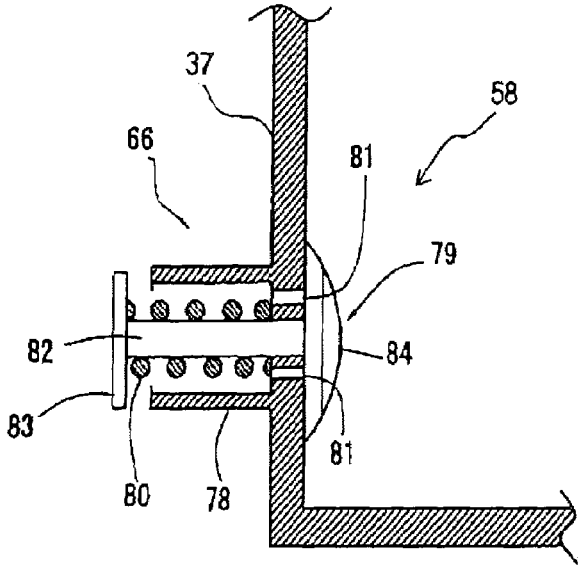
FIG. 3 is a cross sectional view of a connecting portion of a sub-tank.

FIG. 3 is a cross sectional view of a connecting portion 66 of the ink tank 37, which illustrates a structure of a check valve 58.

Referring to FIG. 3, the connecting portion 66 of the ink tank 37 includes an outer cylindrical portion 78, a valve body 79, and a coil spring 80. The outer cylindrical portion 78 protrudes outward from the wall surface of the ink tank 37. The outer cylindrical portion 78 and the ink tank 37 communicate with each other via a plurality of small openings 81. The valve body 79 includes a main shaft 82 which passes through from the inside of the outer cylindrical portion 78 into the ink tank 37, a flange 83 provided at one end of the main shaft 82, a top portion 84 provided at the other end of the main shaft 82 and disposed inside the ink tank 37. The main shaft 82 is slidably supported by the wall surface of the ink tank 37. The main shaft 82 can freely moves into and out of the ink tank 37. The flange 83 is integrally formed with the main shaft 82. The outer diameter of the flange 83 is set to be larger than the outer diameter of the outer cylindrical portion 78. Accordingly, when the main shaft 82 slides to the right side in FIG. 3, the flange 83 abuts on the end face of the outer cylindrical portion 78. The top portion 84 can seal the small openings 81 by abutting on the wall surface of the ink tank 37. The coil spring 80 is disposed inside of the outer cylindrical portion 78. The main shaft 82 is inserted through the coil spring 80.

Accordingly, assuming the case of supplying ink from the ink tank 37 to the sub-tank 29, the flange 83 is resiliently biased to the left side in FIG. 3 by the coil spring 80 at normal times. The top portion 84 abuts the wall surface of the ink tank 37 by the resilient force of the coil spring 80. That is, there is no leakage of ink from the ink tank 37. However, when the connecting portion 66 of the ink tank 37 is engaged with the engaging portion 56 of the sub-tank 29, the flange 83 is pressed by a push rod 57 of the engaging portion 56. This separates the top portion 84 from the wall surface of the ink tank 37. The ink inside the ink tank 37 is ready to be supplied to the sub-tank 29. When the pressurized pump 65 is operated, the ink can be then supplied to the sub-tank 29. The structure of the connecting portion 66 is the same in the other ink tanks.

Figure 4:
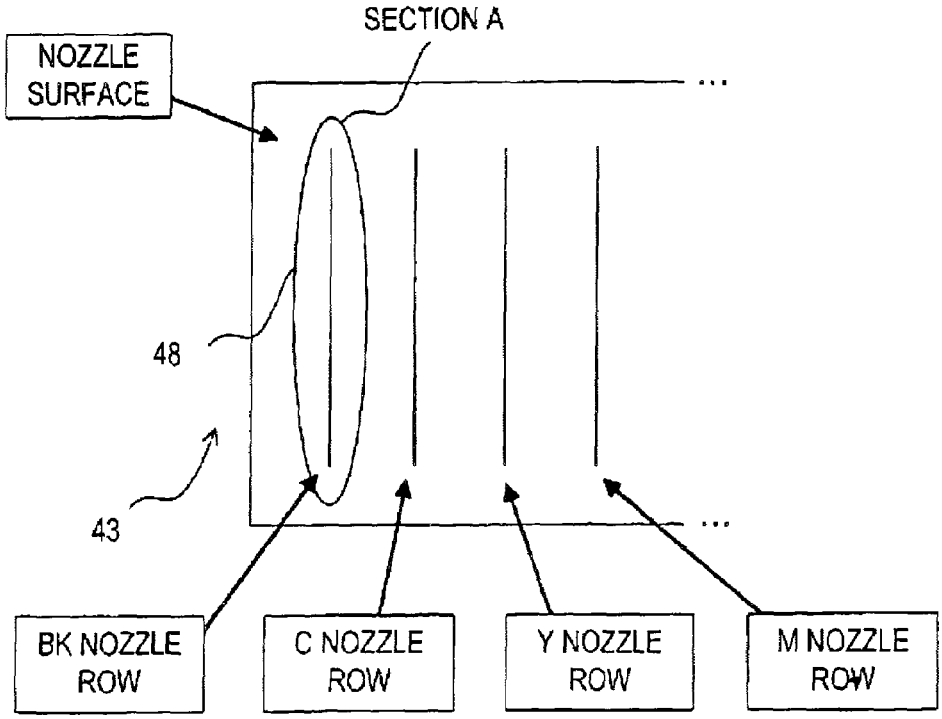
FIG. 4 is an enlarged schematic bottom view of a recording head.
Figure 5:
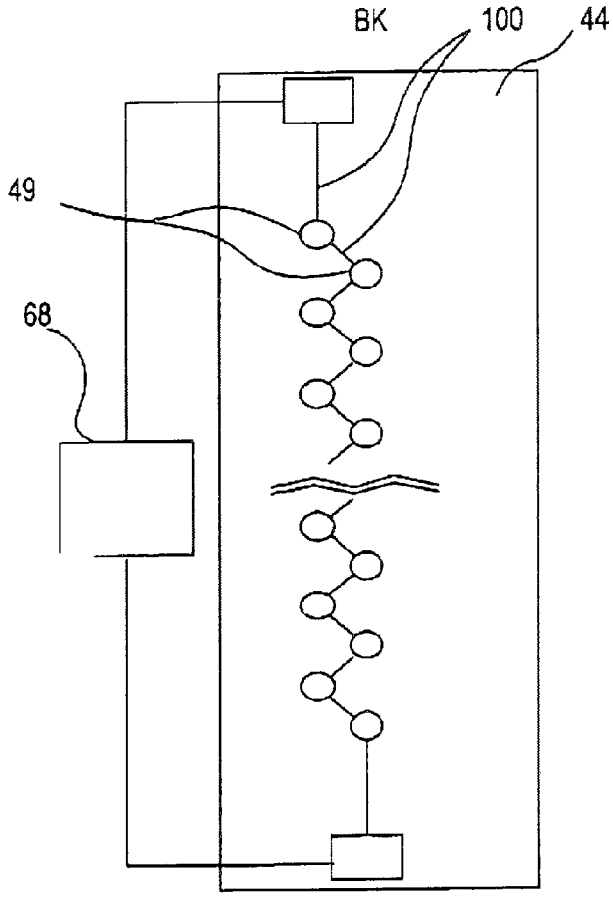
FIG. 5 is an enlarged schematic view of a section A in FIG. 4.

FIG. 4 is an enlarged schematic bottom view of the recording head 43. FIG. 5 is an enlarged schematic view of a section A in FIG. 4. These views diagrammatically show the structure of the recording head 43 in detail.

Referring to FIG. 4, the recording head 43 includes ink ejection portions 48 provided on the downside and arranged in parallel in a vertical direction. In FIG. 4, the vertical direction means a conveying direction of recording sheets. In the present embodiment, there are eight rows of ink ejection portions 48. The ink ejection portions 48 at the leftmost row in FIG. 4 are designed to eject black (Bk) ink. From the other adjacent seven rows of ink ejection nozzles, cyan (C) ink, yellow (Y) ink, magenta (M) ink, blue (B) ink, red (R) ink, green (G) ink, and photo black (Fb) ink are respectively ejected from left to right in this order. That is, the recording head 43 can eject eight colors of ink.

As noted above, the sub-tanks 29 to 32 constitute one sub-tank group and the sub-tanks 33 to 36 constitute the other sub-tank group. In other words, the ink ejection portions 48 for black (Bk) ink, cyan (C) ink, yellow (Y) ink, and magenta (M) ink constitute one nozzle group, and the ink ejection portions 48 for blue (B) ink, red (R) ink, green (G) ink, and photo black (Fb) ink constitute the other nozzle group.

As shown in FIG. 5, the recording head 43 includes a nozzle plate 44, nozzle holes 49, electrodes 100 provided on the nozzle plate 44, and a current sensor 68 which measures a current flowing through the electrodes 100. FIG. 5 only illustrates the nozzle holes 49 and electrodes 100 for black (Bk) ink. The nozzle holes 49 and electrodes 100 for the other colors of ink are omitted.

The current sensor 68 can be a known current sensor. For example, the current sensor 68 includes a power source therein to apply a predetermined voltage to the electrodes 100, and detects a current flowing through the electrodes 100. Based on the current detected by the current sensor 68, it is determined whether the electrodes 100 are in a conduction state.

Figure 6:
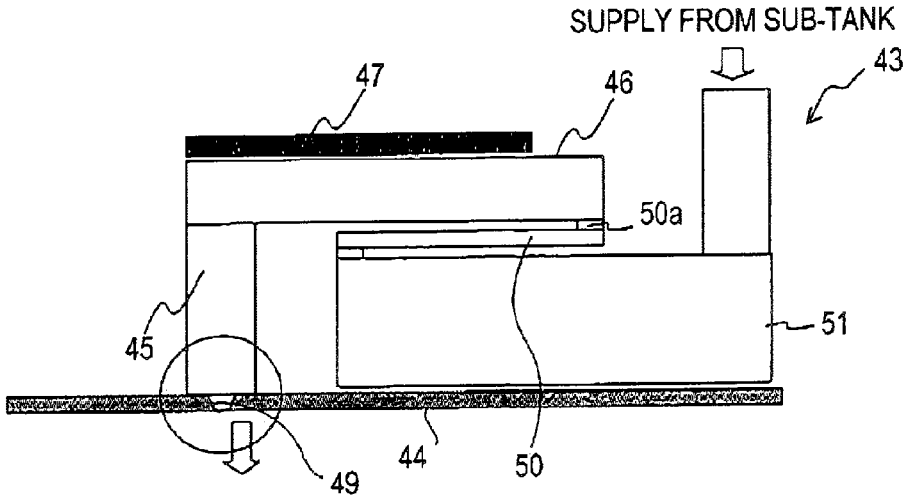
FIG. 6 is an enlarged cross sectional view of the inside of the recording head.

FIG. 6 is an enlarged cross sectional view of the inside of the recording head 43.

Referring to FIG. 6, the nozzle plate 44 is set parallel to a recording sheet. The nozzle holes 49 formed on the nozzle plate 44 are opened downward toward a recording sheet. A descender 45 is provided which communicates with each of the nozzle holes 49. An ink chamber 46 is provided which communicates with the descender 45. The ink chamber 46 is designed such that its capacity is varied according to the drive of a piezoelectric device 47.

The ink chamber 46 communicates with a manifold 51 via an aperture 50*a* provided in an aperture portion 50. The manifold 51 is connected to one of the sub-tanks 29 to 36 via a not shown ink channel. Ink is supplied from the sub-tank 29 to 36 via the manifold 51 and the aperture portion 50 to the ink chamber 46.

Foam having pores is provided in each of the sub-tanks 29 to 36. Due to the capillary phenomenon, ink is absorbed into the foam so that the inside of the sub-tank 29 to 36 is under a negative pressure at all times. The negative pressure inside each of the sub-tanks 29 to 36 is applied to the ink chamber 46 via the manifold 51 and the aperture portion 50. A meniscus formed at each of the nozzle holes 49 is maintained where the surface tension of the meniscus is balanced with the negative pressure in the ink chamber 46.

In the recording head 43, when a voltage is applied to drive the piezoelectric device 47, the capacity of the ink chamber 46 is increased and ink is sucked into the ink chamber 46 via the aperture 50*a*. Then, a meniscus at the nozzle hole 49 moves backward. When the application of voltage to the piezoelectric device 47 is stopped at a predetermined timing, the capacity of the ink chamber 46 is resumed and the meniscus moves forward to be ejected from the nozzle hole 49 as an ink drop.

The aperture 50*a* is formed into a shape predetermined by experiments so as to generate an appropriate channel resistance, such that, in the case of immediate increase in the capacity of the ink chamber 46, a meniscus moves back into the nozzle bole 49 and ink can be sucked into the ink chamber 46 via the aperture 50*a*, and in the case of immediate recovery of the capacity of the ink chamber 46, an ink drop can be ejected from the nozzle hole 49.

On the other hand, each of the sub-tanks 29 to 36 is connected to the pressurized pump 65 via an air channel such as a tube. The pressurized pump 65 includes a tube pump, a charge tank, a switching valve, etc. The pressurized pump 65 supplies pressurized air to the sub-tank 29 to 36 via the air channel so as to apply pressure on the ink inside the sub-tank 29 to 36. The pressure, i.e., 4 kPa, to be applied by the pressurized pump 65 is set in a manner not to break a meniscus formed at the nozzle hole 49.

The piezoelectric device 47 and the pressurized pump 65 are connected to a later explained central processing portion 70. The central processing portion 70 includes a CPU, a ROM, a RAM, etc. to control the multi function apparatus 10 according to a control program relating to the operation of the multi function apparatus 10.

Figure 7C:
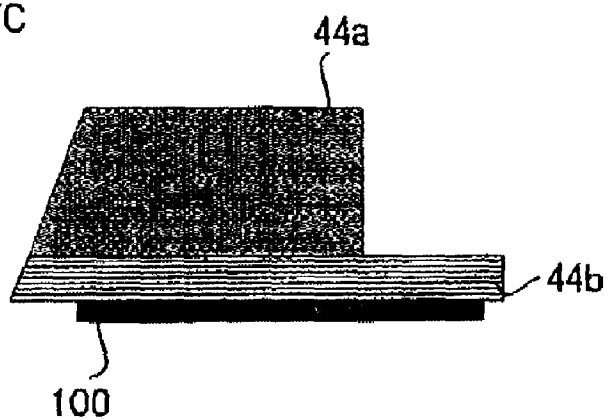
FIG. 7C is an enlarged view of a section C.
Figure 7A:
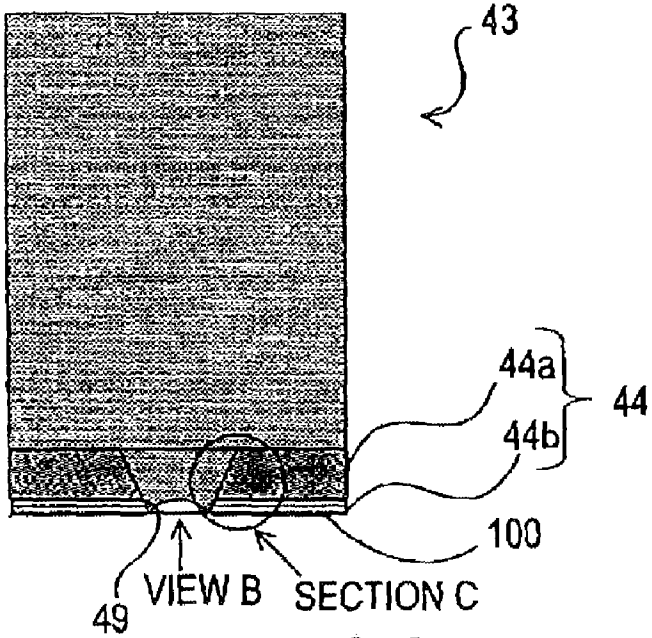
FIG. 7A is an explanatory view showing a nozzle of the recording head.

As shown in FIGS. 7A and 7C, the nozzle plate 44 is formed like a plate having a two-layer structure. That is, the nozzle plate 44 is constituted from an insulating material 44*a* disposed on the descender 45 side and a water shedding film (water shedding layer) 44*b* disposed on the other (outer) side of the insulating material 44*a*. The insulating material 44*a* is made from polyimide, for example. The water shedding film 44*b* is made from fluorine resin, etc. The electrodes 100 are arranged on the surface of the nozzle plate 44, i.e., on the outer side of the water shedding film 44*b*. Furthermore, the respective electrodes 100 are disposed adjacent to each other in such a manner that each of the nozzle holes 49 is arranged therebetween.

Figure 7B:
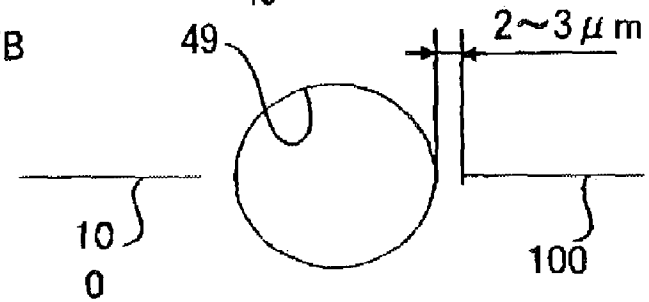
FIG. 7B is a view of the nozzle taken from a direction B.
Figure 8B:
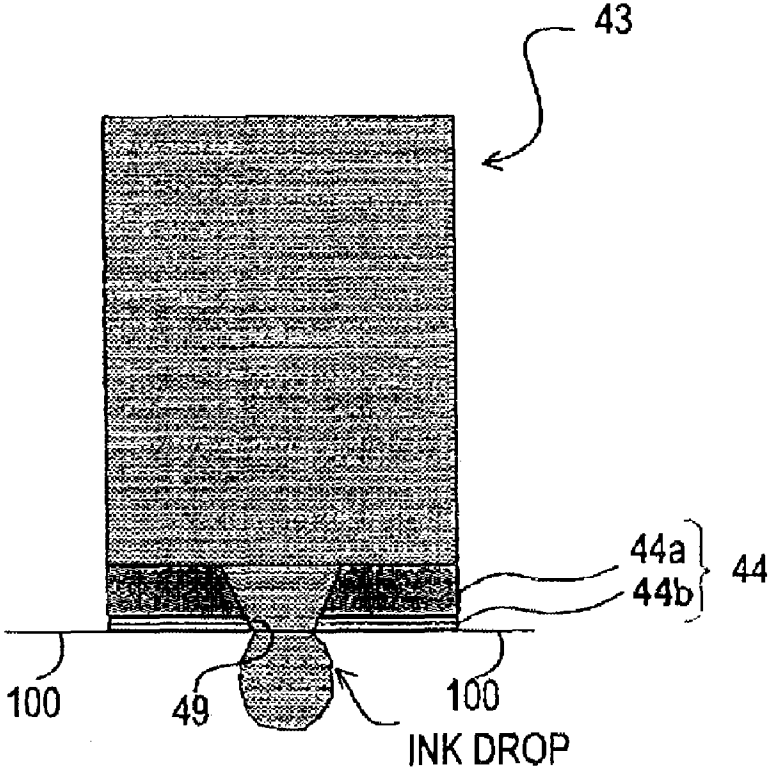
FIGS. 8A and 8B are explanatory views of a meniscus formed in a nozzle opening of the recording head.
Figure 8A:
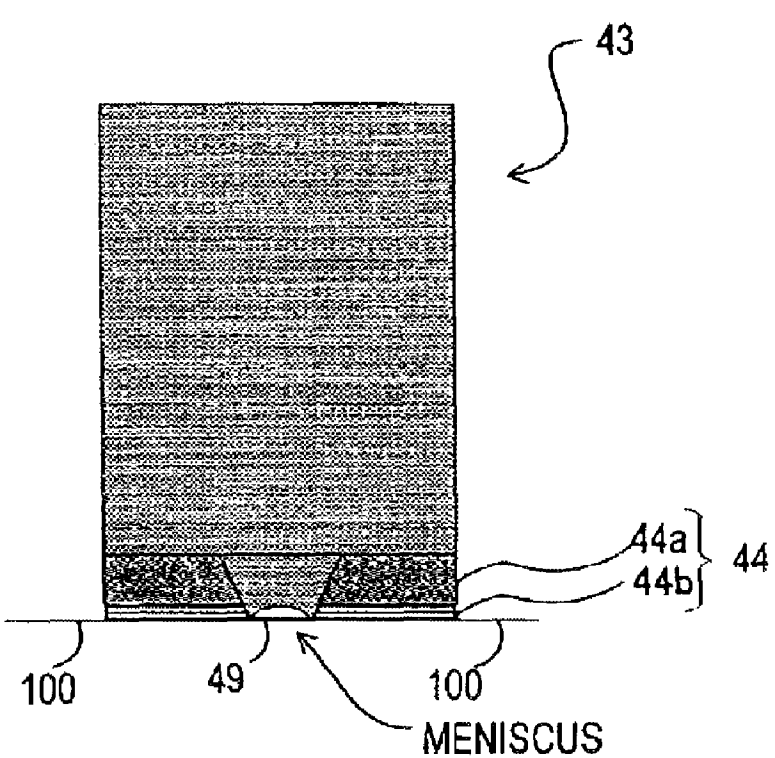
Figure 9A:
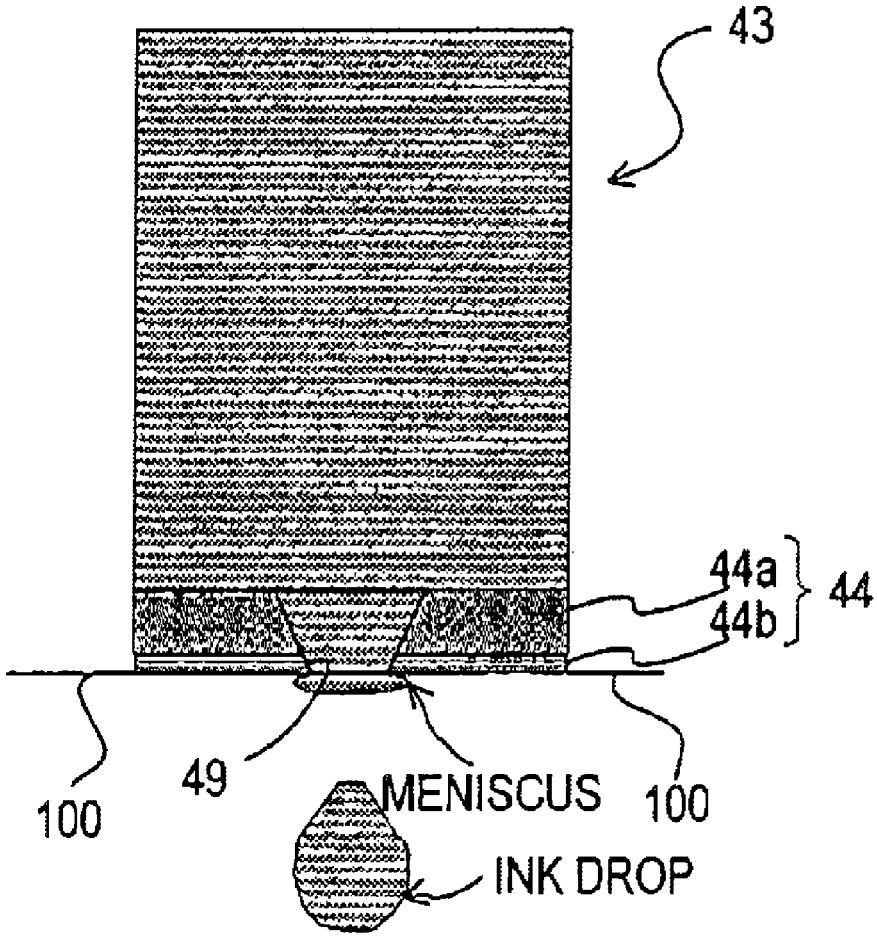
FIGS. 9A and 9B are explanatory views of a meniscus formed in a nozzle opening of the recording head.
Figure 9B:
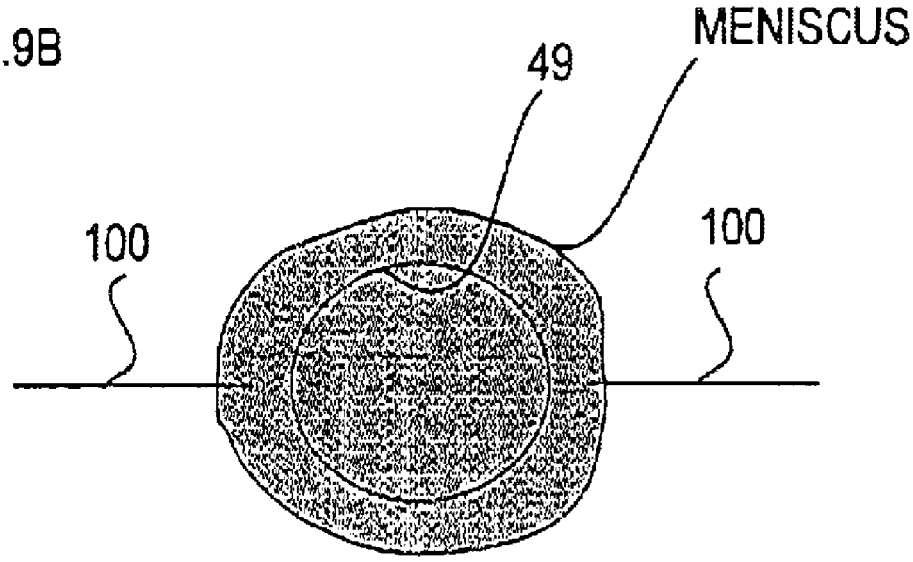

As shown in FIG. 7B, the electrodes 100 are spaced apart from the periphery of the nozzle hole 49 by a predetermined distance d. In the present embodiment, the distance d is set to be 2 to 3 μm. However, the distance d can be set in about 1 to 5 μm without being limited to the above range. The electrodes 100 are arranged such that the respective nozzle holes 49 are connected in series.

FIGS. 8A, 8B, 9A, and 9B are explanatory views of a meniscus formed at each of the nozzle holes 49 of the recording head 43, respectively.

In order to eject an ink drop from the recording head 43 in a favorable manner in image recording, it is necessary for a meniscus to be normally formed inside the nozzle hole 49, and to follow deformation (vibration) of the piezoelectric device 47 provided to the recording head 43. A "normal meniscus" here corresponds to the state in which the fluid surface of ink (meniscus) is formed rounded so as to be concave from the opening periphery toward the inside of the nozzle hole 49, that is, the state in which the edge portion of the fluid surface of ink is positioned at the opening periphery of the nozzle hole 49. When ink is ejected from the nozzle hole 49 as an ink drop in the state where a normal meniscus is formed, the meniscus firstly backs off further to the inside of the nozzle hole 49 due to deformation of the piezoelectric device 47. The ink is then snapped out of the nozzle hole 49 owing to recovery from the deformation of the piezoelectric device 47.

If the air is already inside the nozzle hole 49 before ejection of an ink drop, the fluid surface of ink (meniscus) moves back to the inner part of the nozzle hole 49. In this case, ink cannot burst out from the nozzle hole 49 as an ink drop. Also, if there is any bubble inside the channel upstream of the nozzle hole 49 before ejection of an ink drop, the bubble serves as a sort of a buffer when the piezoelectric device 47 is deformed. Particularly, the deformation of the piezoelectric device 47 fluctuates the ink pressure, and moves the fluid surface of ink (meniscus) once to the inside of the nozzle hole 49. However, with the aforementioned bubble, the fluctuation in the ink pressure only deforms the bubble and cannot pull back the meniscus to the inside of the nozzle hole 49. Accordingly, even if a normal meniscus is formed before ejection of an ink drop, such a bubble can prevent the ink from bursting out of the nozzle hole 49.

On the other hand, when a normal meniscus is formed inside the nozzle hole 49 before ejection of an ink drop and the meniscus follows deformation (vibration) of the piezoelectric device 47, the meniscus is pulled back to the inside of the nozzle hole 49 along with the deformation of the piezoelectric device 47. When the piezoelectric device 47 is recovered from the deformation, the ink in the form of a pillar protrudes out of the nozzle hole 49 (see FIG. 8B). A part of the pillar ink then breaks off and bursts out of the nozzle hole 49 as an ink drop (see FIG. 9A).

When the part of the pillar ink is separated as an ink drop, the pillar ink spreads in a radial direction due to counteraction of the separation of the ink drop and attaches to the vicinity of the opening periphery of the nozzle hole 49. As noted above, since a back pressure (negative pressure) acts on the sub-tank 29 to 36, the pillar ink after separation of an ink drop moves back to the nozzle hole 49 side again. In other words, since the inside of the nozzle hole 49 is under a negative pressure (below air pressure) at all times, the pillar ink backs off as if pulled into the nozzle hole 49. Followed by the retreat, the ink which is attached to the vicinity of the opening periphery of the nozzle hole 49 is also pulled back to the inside of the nozzle hole 49. The ink which has moved to the inside the nozzle hole 49 again forms a normal meniscus.

As noted above, the end part of the pillar ink after an ink drop bursts out of the respective nozzle holes 49 attaches to the vicinity of the opening periphery of the nozzle holes 49. Since the electrodes 100 are adjacently disposed in a manner that each of the nozzle holes 49 is arranged therebetween, the end part of the pillar ink serves as a conductive body which connects the electrodes 100 (see FIG. 9B). Accordingly, when the end part of the ink attaches as if to bridge the electrodes 100, a current can flow between the electrodes 100. The same applies to the other electrodes 100. When a current flows through the electrodes 100 in this manner, the current sensor 68 detects this current and a control device 69 determines that the electrodes 100 are in a conduction state. That is, it is detected that an ink drop has certainly ejected from the respective nozzle holes 49. After the ejection of an ink drop from the nozzle holes 49, the ink again forms a normal meniscus inside the nozzle holes 49 as above. Therefore, after the detection of a current, an insulation state is again detected. Accordingly, since whether an ink drop has certainly ejected from the respective nozzle holes 49 is detected at the time of image recording, any ejection error of an ink drop which may occur due to some trouble can be reliably detected even during printing.

Figure 10:
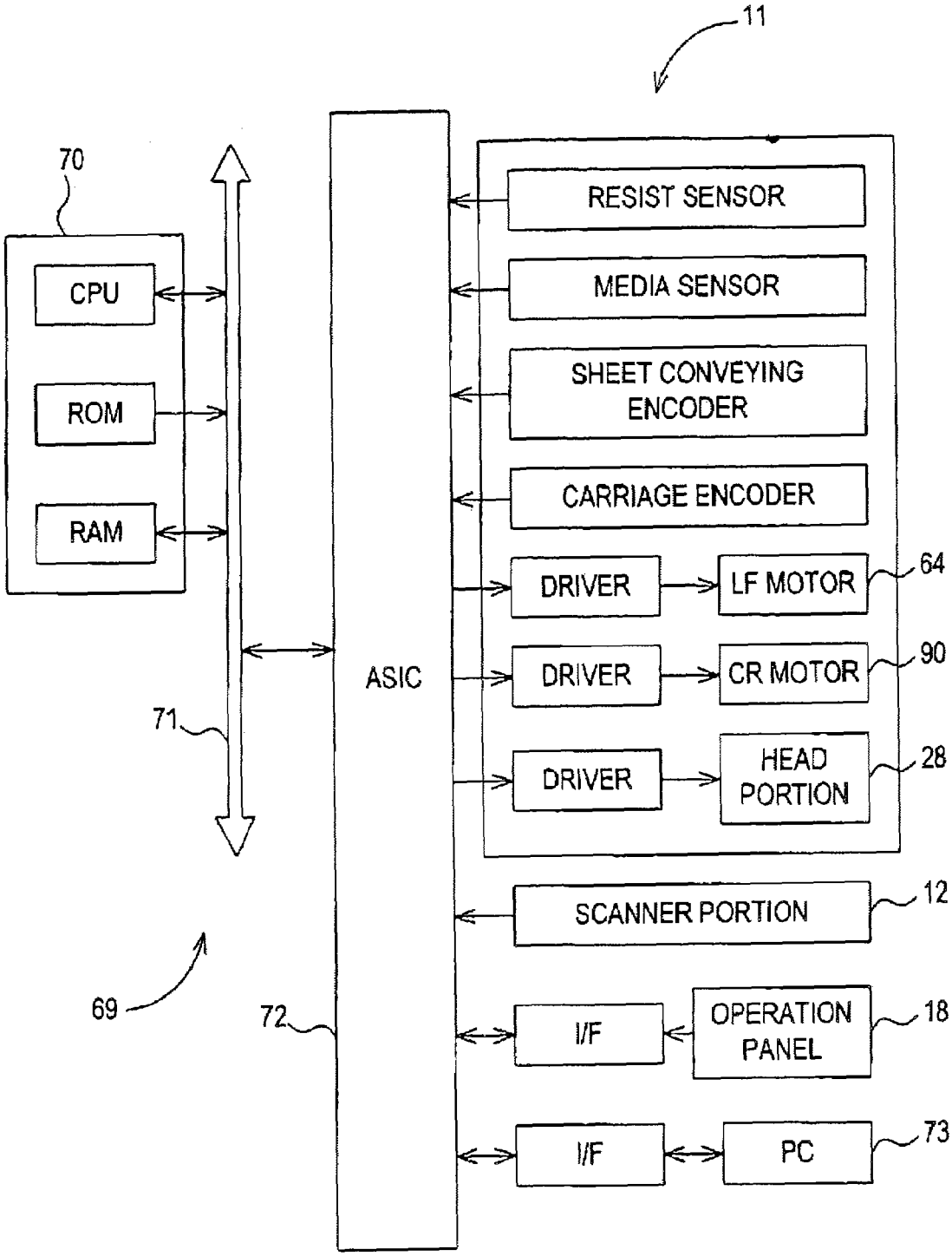
FIG. 10 is a block diagram showing a structure of a control device of the multi function apparatus.

FIG. 10 is a block diagram showing a structure of the control device 69 of the multi function apparatus 10.

As shown in FIG. 10, the control apparatus 69 has a central processing portion 70 including a CPU (central processing unit), a ROM (read only memory), and a RAM (random access memory). The central processing portion 70 is connected to various sensors, the printer portion 11, the scanner portion 12, the operation panel 18, etc. via a bus 71 and an ASIC (application specific integrated circuit) 72 so as to transmit and receive data.

The ROM of the central processing portion 70 stores a predetermined computer program. The CPU performs various calculations by the computer program based on information from the various sensors. Thereby, the CPU collectively controls rotation of a motor 64 (LF motor) as a driving source of a driving roller 60, rotation of a belt driving motor 90 (CR motor) for sliding the head portion 28, expansion and contraction of a not shown slide cylinder for moving the ink tanks 37 to 40 toward the head portion 28 side, and pressure of the pressurized pump 65 for supplying basic color inks inside the ink tanks 37 to 40 to the sub-tanks 29 to 36 side.

The multi function apparatus 10 is connected to e.g., a personal computer (PC) 73, and, in addition to inputs from the operation panel 18, can record images and documents onto recording sheets based on image data and document data transmitted from the personal computer 73. For this purpose, the multi function apparatus 10 is also provided with an interface (I/F) to transmit and receive data to and from the personal computer 73. The structure of the control device 69 shown in the present embodiment is only an example. Therefore, the other structures may be adopted as far as the control device can perform the control which is described below.

Figure 11:
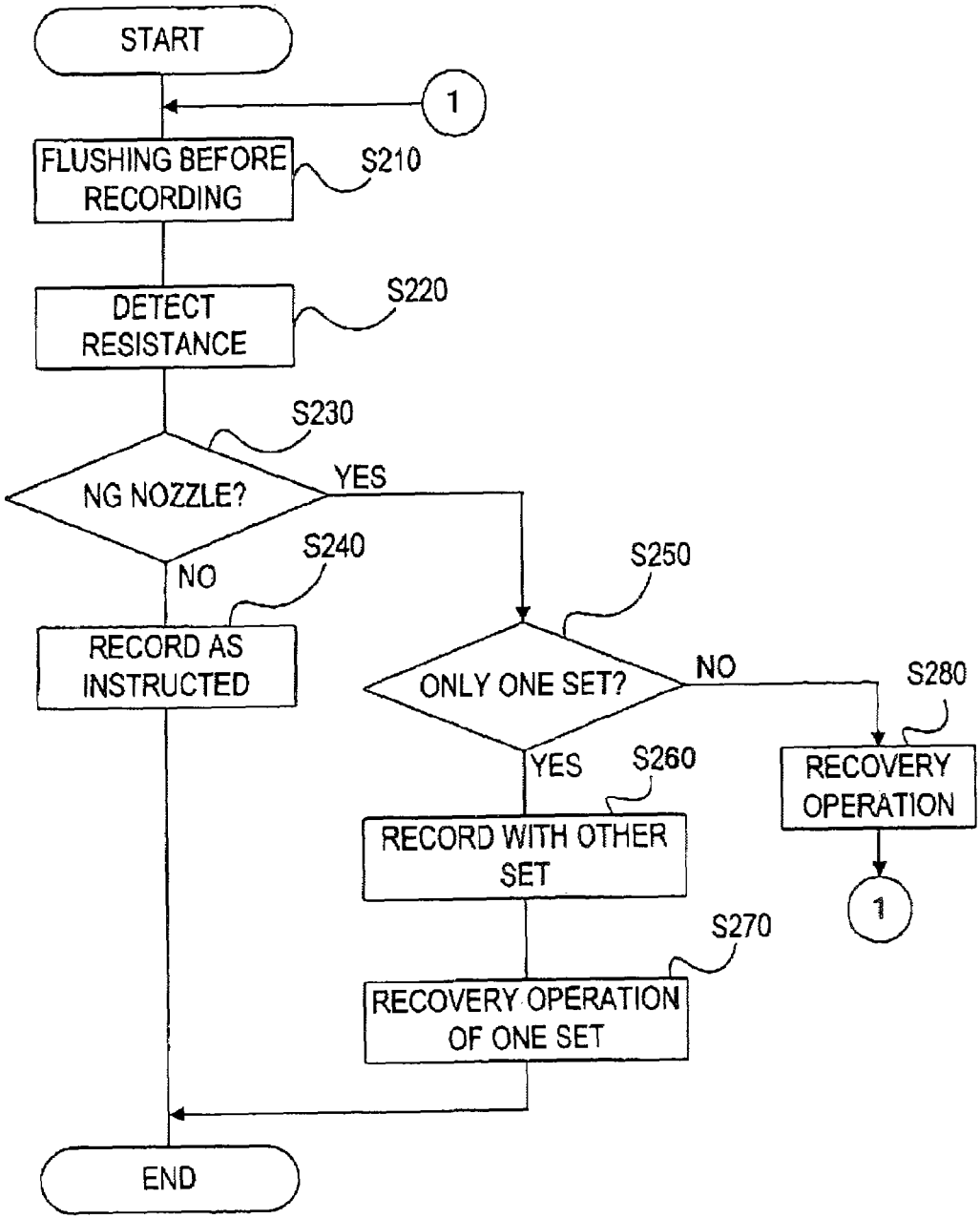
FIG. 11 is a flowchart showing the steps of a recording process.

FIG. 11 is a flowchart showing the steps of a recording process.

This process is executed when power is on.

First, main power of the multi function apparatus 10 is turned on. The process stands by until receipt of recording instructions. Upon receipt of recording instructions, flushing is performed before starting the recording (S210). Resistance of the respective nozzles is detected (S220).

When it is determined that there is no nozzle in a state of non-ejection of ink based on the detected resistance of the respective nozzles (S230: N), the recording is performed according to the instructions (S240) and the process is ended. On the other hand, when it is determined that there is one or more nozzles in a non-ejection state (S230: Y), it is then determined whether only one of the two nozzle groups includes the nozzle(s) in a non-ejection state.

Figure 11A:
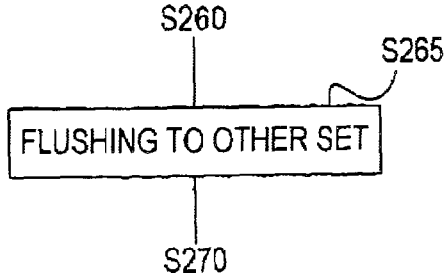
FIG. 11A illustrates an optional step in the recording process of FIG. 11.

When it is determined that not only one of the two nozzle groups includes the nozzle(s) in a non-ejection state, i.e., it is determined that both nozzle groups include the nozzle(s) in a non-ejection state (S250: N), a recovery operation is performed (S280) and the process moves to S210. On the other hand, when it is determined that only one of the two nozzle groups includes the nozzle(s) in a non-ejection state (S250: Y), the recording is performed according to the instructions using the nozzle group without the nozzle(s) in a non-ejection state (S260). Then, a recovery operation is performed to the nozzle group with the nozzle(s) in a non-ejection state (S270), and the process is ended. As shown in FIG. 11A, S265 may be inserted between S260 and S270. That is, in S265, flushing is performed to the nozzle group used for recording. In this manner, maintenance is performed also to the nozzle group used for recording.

Figure 12:
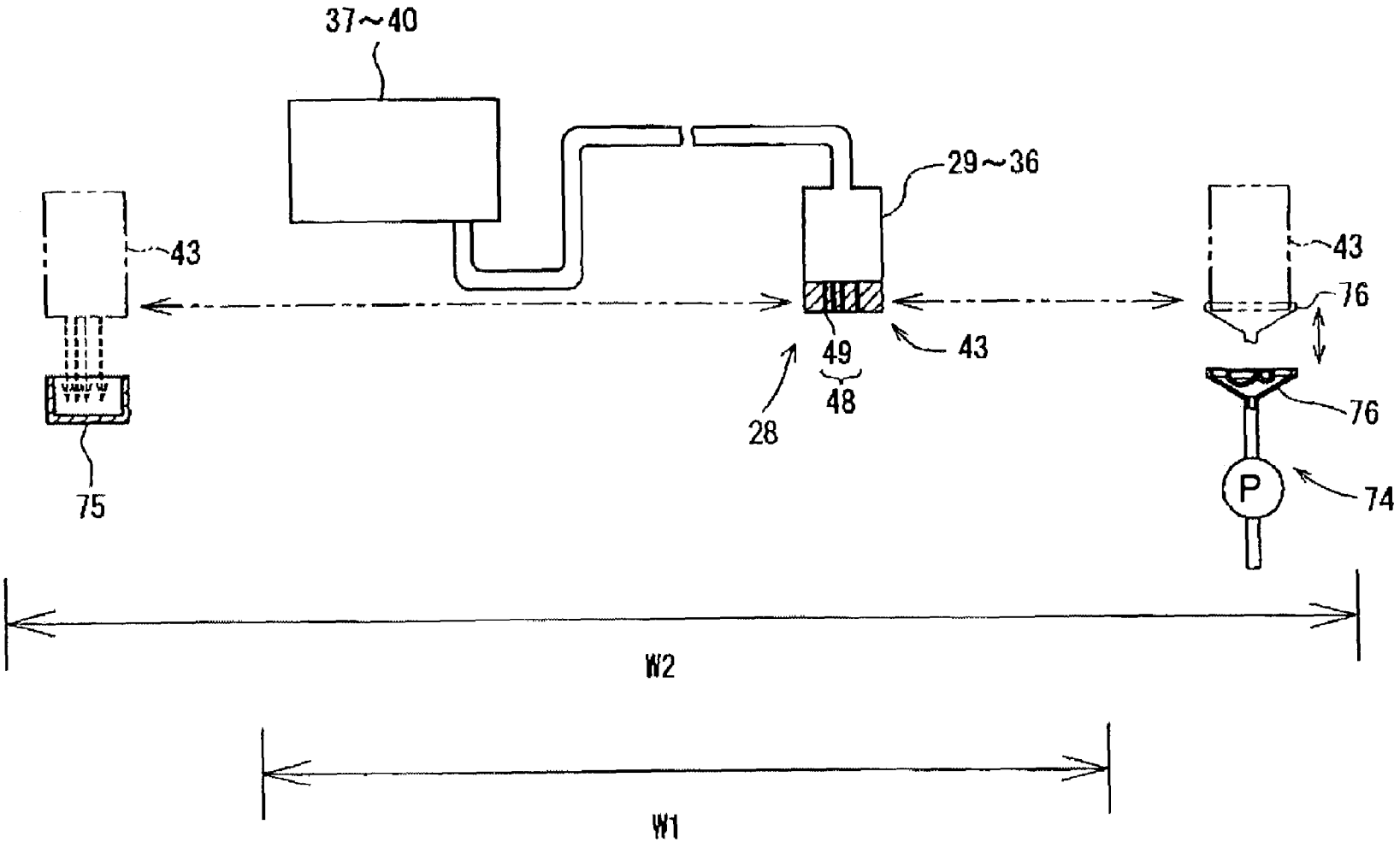
FIG. 12 is a diagram showing an ink supply channel and active positions of the recording head.

FIG. 12 diagrammatically shows a feed path of ink to the recording head 43 from the ink tanks 37 to 40 via the sub-tanks 29 to 36, and active positions of the recording head 43.

Ink supplied from the ink tanks 37 to 40 to the sub-tanks 29 to 36 flow to the manifold 51 via the ink channels to be distributed to the nozzle holes 49 via the ink chambers 46 and the descenders 45. The ink is then ejected from the respective nozzle holes 49 as ink drops. In this manner, as the recording head 43 slides in an image recording range W1 while ejecting ink drops of respective colors of ink, an image is recorded on a recording sheet conveyed below the recording head 43.

Also as shown in FIG. 12, on both ends of a scannable range W2 outside the image recording range W1 of the recording head 43, a purge mechanism 74 and a waste ink tray 75 are disposed. The purge mechanism 74 sucks and removes bubbles and foreign bodies from the nozzle holes 49, etc. of the recording head 43. When the recording head 43 slides to the right end of the scannable range W2, a cap 76 of the purge mechanism 74 moves upward and is closely attached to the downside of the recording head 43 so as to cover the nozzle holes 49. A not shown suction pump is connected to the cap 75. By the operation of this suction pump, ink is sucked from the nozzle holes 49 of the recording head 43. The control device 69 controls the drive of the belt driving motor 90 for sliding the recording head 43, the movement of the cap 76, and the drive of the suction pump.

The waste ink tray 75 receives flushing of the recording head 43. In flushing, the record head 43 is moved to the left end of the scannable range W2, and the respective colors of ink is ejected toward the waste ink tray 75 in that position. The respective locations of the purge mechanism 74 and the waste ink tray 75 are not specifically limited to those of the present embodiment. It is also possible to exchange their locations, or they can be both disposed on either side.

The head portion 28 holding the ink tanks 37 to 40 is set at the right end (home position) of the scannable range W2. The head portion 28 may be arranged at the left end. Respective basic color inks (Bk ink, C ink, Y ink and M ink) stored in the ink tanks 37 to 40 are supplied to the sub-tanks 29 to 36 as below.

Figure 13:
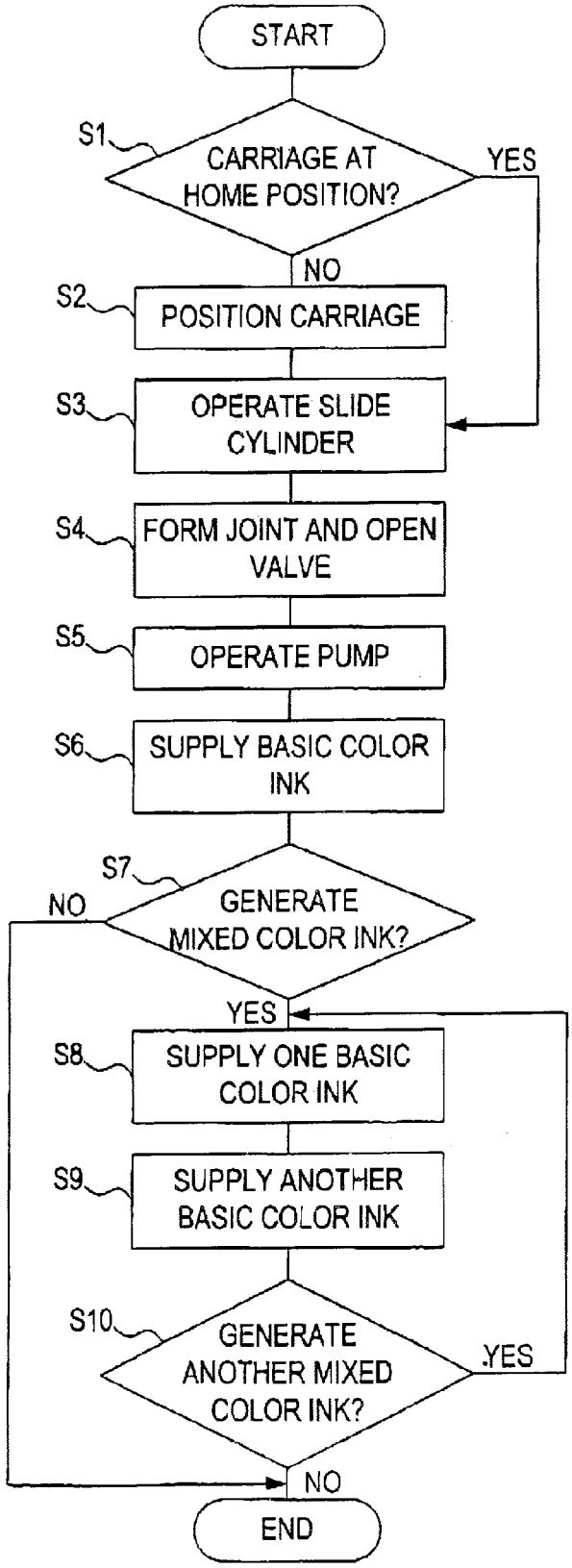
FIG. 13 is a flowchart showing how basic color inks are supplied from ink tanks to sub-tanks.

FIG. 13 is a flowchart showing how the basic color inks are supplied from the ink tanks 37 to 40 to the sub-tanks 29 to 36.

First, the basic color inks are supplied from the ink tanks 37 to 40 to the basic color sub-tanks 29 to 32 out of the sub-tanks 29 to 36. Particularly, it is determined whether the scanning carriage 42 of the head portion 28 is disposed at the home position, that is, at the end (e.g., right end) part of the scannable range W2 (Step 1: S1). This determination is easily performed by providing a position sensor for the scanning carriage 42 such as an encoder.

When the scanning carriage 42 is not disposed at the home position, the belt driving motor 90 is driven to set the scanning carriage 42 at the home position (Step 2: S2). Subsequently, the slide cylinder is operated (Step 3: S3), and the connecting portions 66 of the respective ink tanks 37 to 40 and the engaging portions 56 of the sub-tanks 29 to 32 are engaged/connected. As a result, the check valves 58 of the connecting portions 66 are opened (Step 4: S4). Furthermore, the pressurized pumps 65 are operated (Step 5: S5), and the basic color inks are independently supplied to the respective sub-tanks 29 to 32 (Step 6: S6). The aforementioned control device 69 controls the drive of the belt driving motor 90, and the operation of the slide cylinder and the pressurized pump 65. When the scanning carriage 42 has been disposed at the home position from the first, the aforementioned Step 2 is skipped.

Subsequently, it is determined whether generation of a mixed ink is necessary (Step 7: S7). This determination is easily performed by providing a sensor which detects ink levels (levels of ink fluid surfaces) in the respective sub-tanks 29 to 36. When generation of any mixed ink is to be performed (typically, when the levels of any of the mixed ink inside the sub-tanks 33 to 36 are low), the belt driving motor 90 is driven to set the scanning carriage 42 at a predetermined position. The "predetermined position" in this case corresponds to the position where any of the sub-tanks 33 to 36 (e.g., sub-tank 33) to which ink is added faces one of the ink tanks 37 to 49 (e.g., ink tank 38) storing the basic color ink to be supplied. Subsequently, the slide cylinder is operated, and the connecting portion 66 of the predetermined ink tank 37 to 40 (e.g., ink tank 38) and the engaging portion 56 of the sub-tank 29 to 36 (e.g., sub-tank 33) is engaged/connected. As a result, the check valve 58 of the connecting portion 66 is opened. Furthermore, the pressurized pump 65 is operated, and one basic color ink is supplied from the sub-tank 29 to 36 to the ink tank 37 to 40 (e.g., from the sub-tank 33 to the ink tank 38) (Step 8: S8).

Similarly, the belt driving motor 90 is driven to set the scanning carriage 42 at a predetermined position. The "predetermined position" in this case corresponds to the position where any of the sub-tanks 33 to 36 (e.g., sub-tank 33) to which ink is added faces one of the ink tanks 37 to 40 (e.g., ink tank 39) storing another basic color ink to be supplied. Subsequently, the slide cylinder is operated, and the connecting portion 66 of the predetermined ink tank 37 to 40 (e.g., ink tank 39) and the engaging portion 56 of the sub-tank 29 to 36 (e.g., sub-tank 33) is engaged/connected. As a result, the check valve 58 of the connecting portion 66 is opened. Furthermore, the pressurized pump 65 is operated, and another basic color ink is supplied from the sub-tank 29 to 36 to the ink tank 37 to 40 (e.g., from the sub-tank 33 to the ink tank 39) (Step 9: S9).

By means of the above Steps 8 and 9, a mixed ink is generated. Subsequently, it is determined whether generation of another mixed ink is necessary (Step 10: S10). If determined necessary, another mixed ink is generated in the same manner as in Steps 8 and 9. If not, the ink mixing operation is ended. The control device 69 controls the drive of the belt driving motor 90, and the operation of the slide cylinder and the pressurized pump 65 also in the generation of a mixed ink.

Figure 14:
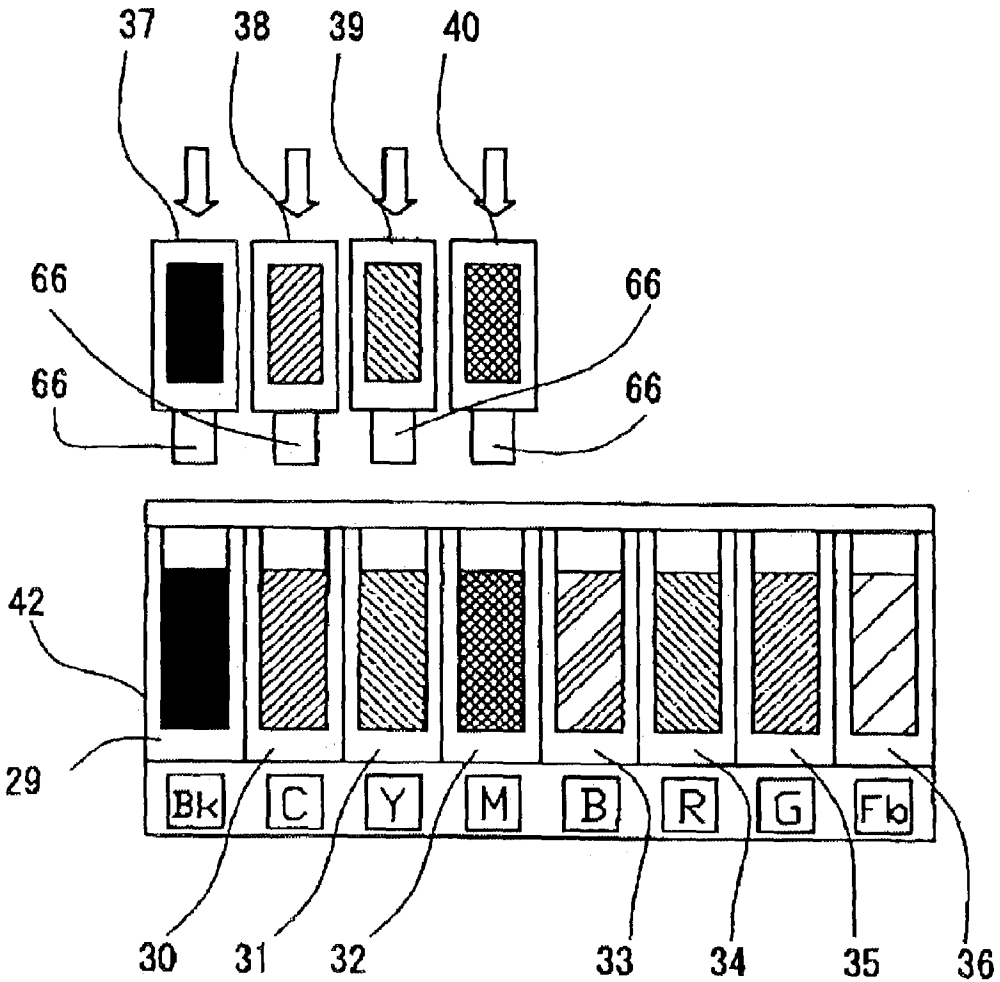
FIG. 14 is a diagram showing how basic color inks are supplied from ink tanks to sub-tanks.

FIG. 14 is a diagram illustrating in detail how the basic color inks (Bk ink, C ink, Y ink, and M ink) are supplied from the ink tanks 37 to 40 to the basic color sub-tanks 29 to 32. From now on, how the basic color inks are fed to the basic color sub-tanks 29 to 32 is explained in detail.

According to the above Steps 2 to 6 (see FIG. 13), the scanning carriage 42 is set in position and the respective ink tanks 37 to 40 are connected to the sub-tanks 29 to 32. Here, the connecting portions 66 of the respective ink tanks 37 to 40 are engaged with the engaging portions 56 of the sub-tanks 29 to 32, and the basic color inks are supplied to the sub-tanks 29 to 32 by the operation of the pressurized pumps 65. In the present embodiment, the sub-tanks 29 to 32 store Bk ink, C ink, Y ink, and M ink, respectively. That is, the sequence of the sub-tanks 29 to 32 is identical to the sequence of the ink tanks 37 to 40. The sequences of the sub-tanks 29 to 32 and of the ink tanks 37 to 40 may not be necessarily the same if only each one of the sub-tanks 29 to 32 and the ink tanks 37 to 40 are to be connected.

Figure 15B:
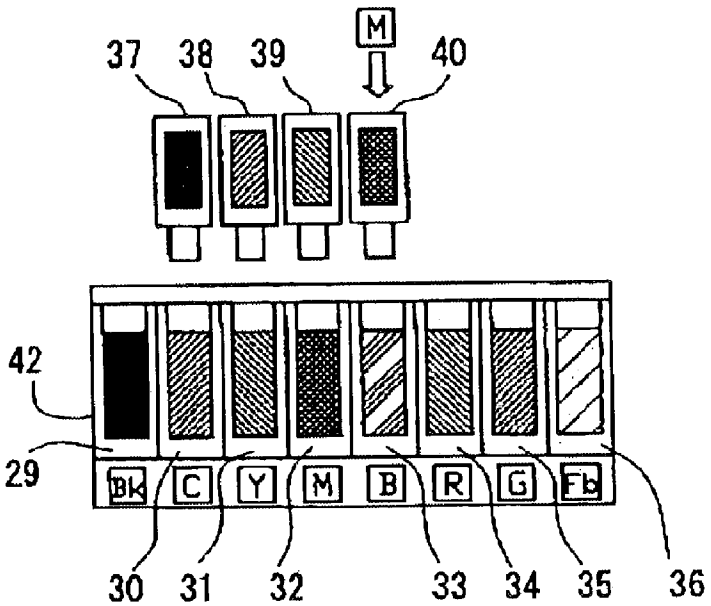
FIGS. 15A and 15B are diagrams showing how B ink is generated.
Figure 15A:
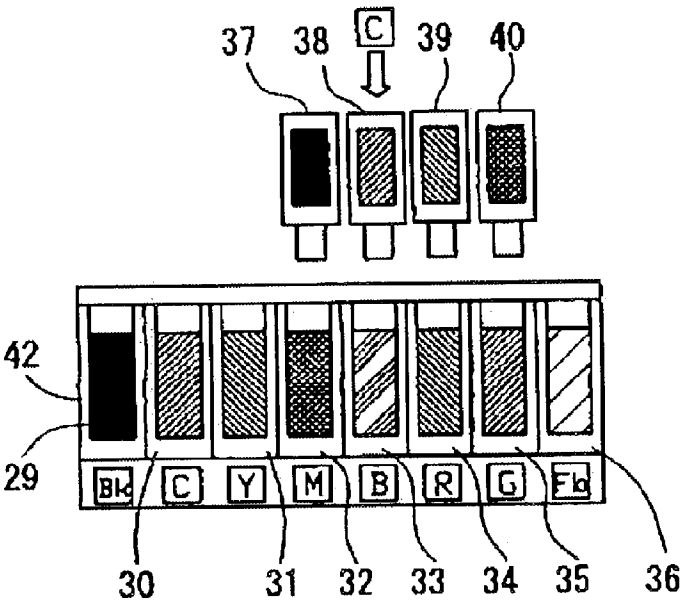

Now, a mixed ink (B ink) is generated in the sub-tank 33. FIGS. 15A and 15B are diagrams showing how to generate B ink.

B ink is generated by mixing C ink and M ink. As shown in FIG. 15A, the scanning carriage 42 slides to connect the ink tank 38 to the sub-tank 33. The sub-tank 33 is a mixed color sub-tank allocated to generate a mixed ink (B ink). Here, the connecting portion 66 of the ink tank 38 is engaged with the engaging portion 56 of the sub-tank 33. C ink is supplied to the sub-tank 33 by the operation of the pressurized pump 65. Subsequently, as shown in FIG. 15B, the scanning carriage 42 slides to connect the ink tank 40 to the sub-tank 33. The connecting portion 66 of the ink tank 40 is engaged with the engaging portion 56 of the sub-tank 33. M ink is supplied to the sub-tank 33 by the operation of the pressurized pump 65. As a result, B ink is generated in the sub-tank 33. In generation of B ink, M ink may be supplied to the sub-tank 33 before C ink. However, it is preferable that inks are fed to the sub-tank 33 in the order of color from light to dark among the plurality of basic color inks to be mixed.

Figure 16B:
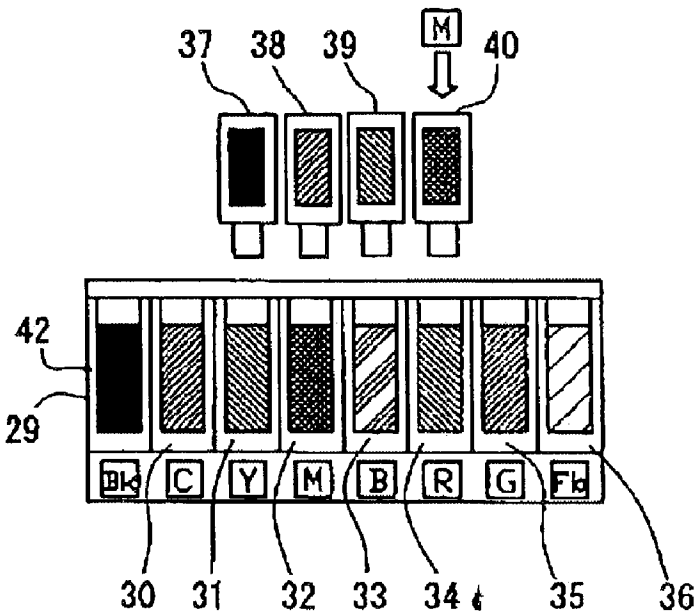
FIGS. 16A and 16B are diagrams showing how R ink is generated.
Figure 16A:
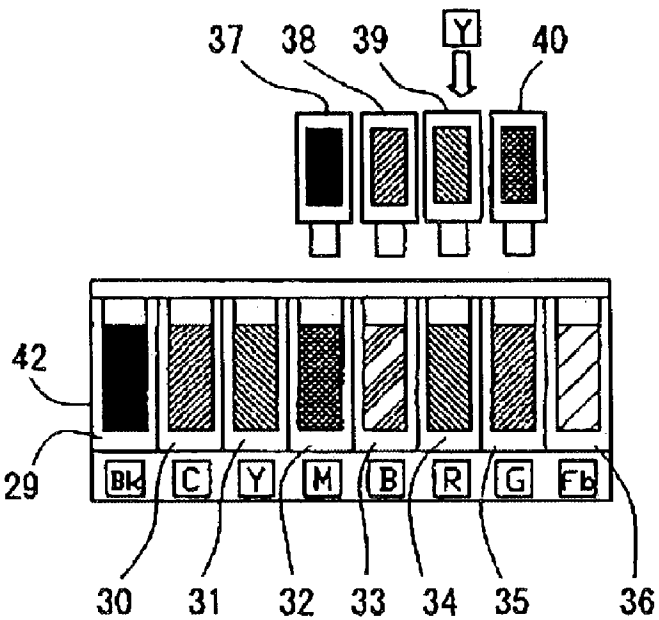

Next, another mixed ink (R ink) is generated in the sub-tank 34. FIGS. 16A and 16B are diagrams showing how to generate R ink.

R ink is generated by mixing Y ink and M ink among the basic color inks. First, as shown in FIG. 16A, the scanning carriage 42 slides to connect the ink tank 39 to the sub-tank 34. The sub-tank 34 is a mixed color sub-tank allocated to generate a mixed ink (R ink). Here, the connecting portion 66 of the ink tank 39 is engaged with the engaging portion 56 of the sub-tank 34 and Y ink is supplied to the sub-tank 34 by the operation of the pressurized pump 65. Subsequently, as shown in FIG. 16B, the scanning carriage 42 slides to connect the ink tank 40 to the sub-tank 34. The connecting portion 66 of the ink tank 40 is engaged with the engaging portion 56 of the sub-tank 34 and M ink is supplied to the sub-tank 34 by the operation of the pressurized pump 65. As a result, R ink is generated in the sub-tank 34. In generation of R ink, M ink may be supplied to the sub-tank 34 before Y ink. However, it is preferable that ink is fed to the sub-tank 34 in the order of color from light to dark among the plurality of basic color inks to be mixed.

Figure 17B:
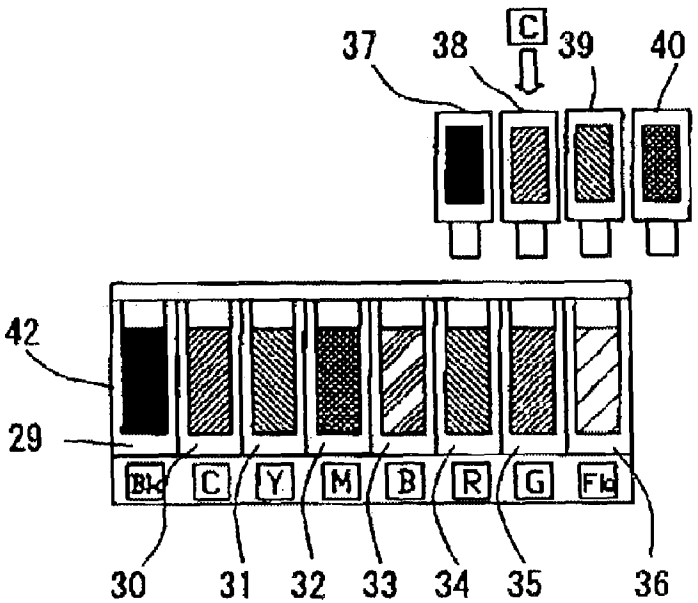
FIGS. 17A and 17B are diagrams showing how G ink is generated.
Figure 17A:
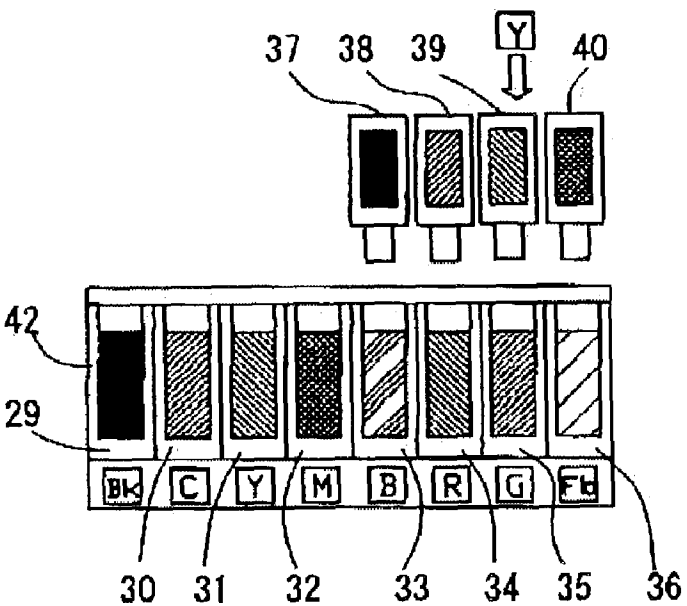

Next, another mixed ink (G ink) is generated in the sub-tank 35. FIGS. 17A and 17B are diagrams showing how to generate G ink.

G ink is generated by mixing Y ink and C ink among the basic color inks. First, as shown in FIG. 17A, the scanning carriage 42 slides to connect the ink tank 39 to the sub-tank 35. The sub-tank 35 is a mixed color sub-tank allocated to generate a mixed ink (G ink). Here, the connecting portion 66 of the ink tank 39 is engaged with the engaging portion 56 of the sub-tank 35 and Y ink is supplied to the sub-tank 35 by the operation of the pressurized pump 65. Subsequently, as shown in FIG. 17B, the scanning carriage 42 slides to connect the ink tank 38 to the sub-tank 35. The connecting portion 66 of the ink tank 38 is engaged with the engaging portion 56 of the sub-tank 35 and C ink is supplied to the sub-tank 35 by the operation of the pressurized pump 65. As a result, G ink is generated in the sub-tank 35. In generation of G ink, it is preferable that Y ink may be supplied to the sub-tank 35 before C ink as in the present embodiment. That is, it is preferable that ink is fed to the sub-tank 35 in the order of color from light to dark among the plurality of basic color inks to be mixed. C ink may be fed to the sub-tank 35 first.

Figure 18A:
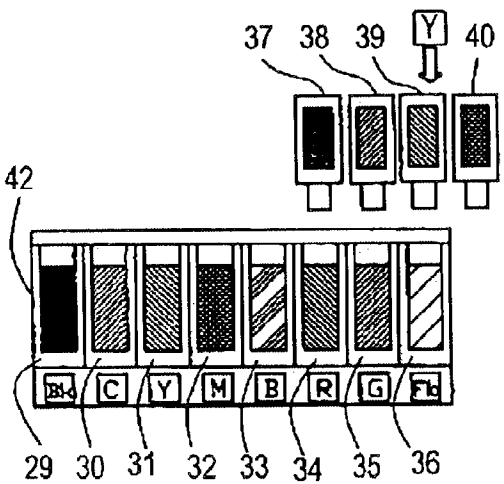
FIGS. 18A, 18B, and 18C are diagrams showing how Fb ink is generated.
Figure 18B:
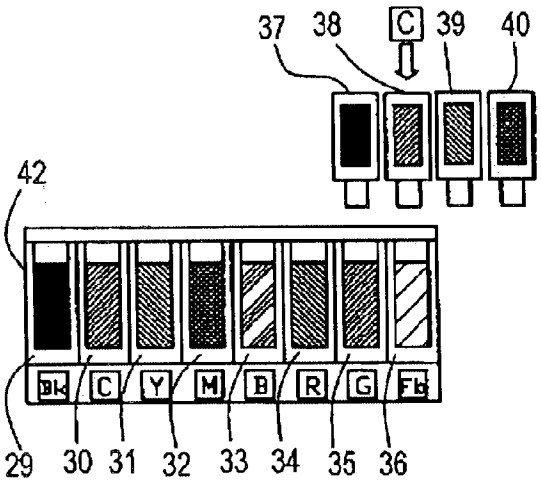

Next, another mixed ink (Fb ink) is generated in the sub-tank 36. FIGS. 18A and 18B are diagrams showing how to generate Fb ink.

Figure 18C:
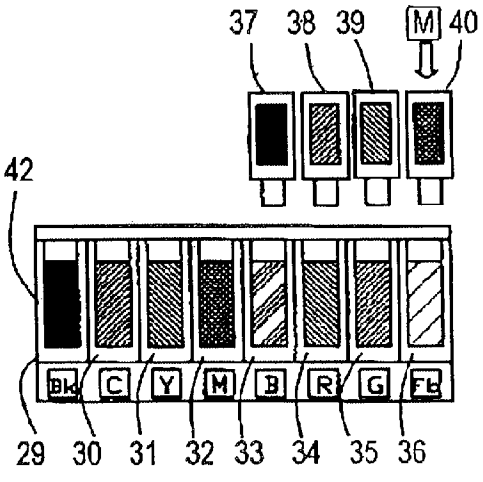

Fb ink is generated by mixing Y ink, C ink, and M ink among the basic color inks. First, as shown in FIG. 18A, the scanning carriage 42 slides to connect the ink tank 39 to the sub-tank 36. The sub-tank 36 is a mixed color sub-tank allocated to generate a mixed ink (Fb ink). Here, the connecting portion 66 of the ink tank 39 is engaged with the engaging portion 56 of the sub-tank 36 and Y ink is supplied to the sub-tank 36 by the operation of the pressurized pump 65. Subsequently, as shown in FIG. 18B, the scanning carriage 42 slides to connect the ink tank 38 to the sub-tank 36. The connecting portion 66 of the ink tank 38 is engaged with the engaging portion 56 of the sub-tank 36 and C ink is supplied to the sub-tank 36 by the operation of the pressurized pump 65. Subsequently, as shown in FIG. 18C, the scanning carriage 42 slides to connect the ink tank 40 to the sub-tank 36. The connecting portion 66 of the ink tank 40 is engaged with the engaging portion 56 of the sub-tank 36 and M ink is supplied to the sub-tank 36 by the operation of the pressurized pump 65. As a result, Fb ink is generated in the sub-tank 36. In generation of Fb ink, Y ink, M ink, and C ink may be supplied to the sub-tank 36 in this order. That is, it is preferable that inks are fed to the sub-tank 35 in the order of color from light to dark among the plurality of basic color inks to be mixed.

In this manner, the basic color inks are fed from the ink tanks 37 to 40 to sub-tanks 29 to 36, so that eight colors of ink is generated from the ink tanks 37 to 40 storing four colors of basic color inks to be stored in the sub-tanks 29 to 36. In the present embodiment, the basic color inks are four colors of ink, i.e., Bk ink, C ink, Y ink, and M ink. However, there is no limitation of the number of the basic color inks. There may be n colors of basic color inks stored in the ink tanks. In this case, by mixing n colors of basic color inks, there is multiple number of mixed ink, i.e., m (m>n) colors of ink, stored in the sub-tanks.

The multi function apparatus 10 may be designed to perform head cleaning of the recording head 43 by the aforementioned ink suction operation and flushing operation in the state that the sub-tanks 29 to 36 are filled with ink. Such head cleaning operation is easily performed by the computer program recorded in the ROM (see FIG. 6) of the control device 69.

[Effects]

(1) According to the multi function apparatus 10 of the present embodiment, in the case of detection of a non-ejection state in any of the ejection nozzles, selection is performed of one without any of the ejection nozzle(s) in a non-ejection state out of the plurality of ejection nozzle groups to perform image recording. Therefore, even in the case of non-ejection in the ejection nozzles of the recording head 43, image recording can be promptly resumed e.g., without a recovery operation.

(2) According to the multi function apparatus 10 of the present embodiment, when image recording is performed by selecting one ejection nozzle group without any of the ejection nozzle(s) in a non-ejection state, maintenance is performed at least on the nozzle group without the ejection nozzle(s) in a non-ejection state. Accordingly, even if frequent use is made to the ejection nozzle group without the ejection nozzle(s) in a non-ejection state, it is possible to prevent the ejection nozzle group from falling in a non-ejection state.

Maintenance may be performed to all the ejection nozzle groups. In this manner, any of the ejection nozzle(s) in a non-ejection state is cleaned and turned to be in an ejectable state. In this manner, upon the next image recording, all the nozzle groups become selectable.

(3) According to the multi function apparatus 10 of the present embodiment, if all of the ejection nozzle groups are detected to include one or more ejection nozzle(s) in a non-ejection state, maintenance is performed to all the ejection nozzle groups. In this manner, it is possible to prevent all the nozzle groups from failing to be in an ejectable state.

[Other Embodiments]

An embodiment of the present invention is described in the above. However, the present invention should not be limited to the above embodiment and can be practiced in various manners as below.

(1) In the recording process of the above embodiment, when it is determined that only one out of the two ejection nozzle groups includes the nozzle(s) in a non-ejection state (S250: Y), recording is performed as instructed using the other nozzle group without any of the nozzle(s) in a non-ejection state (S260). A recovery operation is further performed to the nozzle group with the nozzle(s) in a non-ejection state (S270). However, the recovery operation may be performed based on instructions separately received from the user via the operation panel 18.

Figure 19:
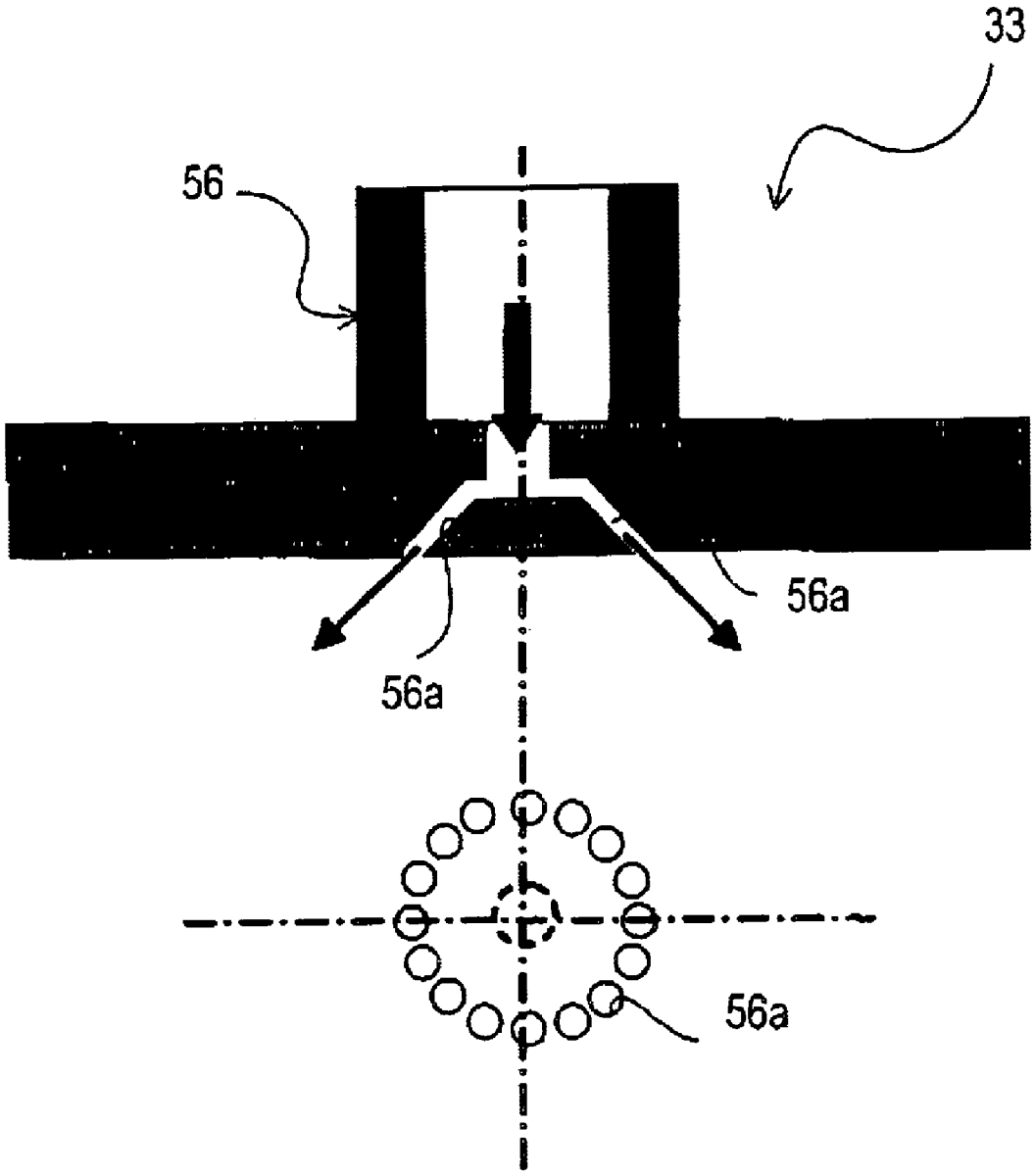
FIG. 19 is an explanatory diagram showing a connecting portion of a sub-tank.

(2) As illustrated in FIG. 19, the engaging portion 56 of the respective sub-tanks 29 to 36 may be provided with plural number of radial openings 56*a*. The radial openings 56*a* are formed such that they are farther from the center of the engaging portion 56 at the downstream side than the upstream side. As a result, the radial openings 56*a* can disperse the ink supplied from the ink tanks 37 to 40 into the sub-tanks 29 to 36. Thus, the ink supplied from the ink tanks 37 to 40 to the sub-tanks 29 to 36 can be mixed with the ink already stored in the sub-tanks 29 to 36 in a short time.

(3) The above embodiment describes the case of color printing using at least one of two ejection nozzle groups. However, the present invention can be applied to the case of black and white printing. Black color can be obtained by ejecting red ink, green ink and blue ink or by ejecting cyan ink, magenta ink and yellow ink on a recording sheet. Accordingly, in the case of non-ejection of one or more nozzles for black ink, ink may be ejected from the respective nozzles for red ink, green ink and blue ink, or cyan ink, magenta ink and yellow ink.

What is claimed is:

1. An ink-jet recording apparatus comprising sub-tanks that store a plurality of colors of ink;

a recording head that includes a plurality of ejection nozzle groups each comprising a plurality of ink ejection portions, each of the ink ejection portions comprising a plurality of ejection nozzles which selectively eject one of the plurality of colors of ink inside a respective one of the sub-tanks to a recording medium;

an image recording control device that selects a first one of the plurality of ejection nozzle groups for image recording onto the recording medium; and a non-ejection status detection device that detects whether any ejection nozzle of the first one of the plurality of nozzle groups is in a non-ejection state, and when the non-ejection status detection device detects that one of the ejection nozzles of the first one of the plurality of nozzle groups is in a non-ejection state, the image recording control device deselects the first one of the plurality of rejection nozzle groups from image recording and selects a second one of the plurality of ejection nozzle groups for image recording, wherein the second one of the plurality of ejection nozzle groups does not include any of the plurality of ejection nozzles which are in the first one of the plurality of ejection nozzle groups.

2. The ink-jet recording apparatus according to claim 1, further comprising a maintenance device that performs maintenance on the ejection nozzle groups of the recording head, wherein when image recording is performed by the image control device selecting one of the plurality of the ejection nozzle groups that is without the ejection nozzle(s) in a non-ejection state, the maintenance device performs maintenance on at least the ejection nozzle group that has performed the image recording among the plurality of ejection nozzle groups.

3. The ink-jet recording apparatus according to claim 1, further comprising a maintenance device that performs maintenance on the ejection nozzle groups of the recording head, wherein when image recording is performed by the image control device selecting one of the plurality of ejection nozzle groups that is without the ejection nozzle(s) in a non-ejection state, the maintenance device performs maintenance on at least the ejection nozzle group with the ejection nozzle(s) in a non-ejection state among the plurality of ejection nozzle groups.

4. The ink-jet recording apparatus according to claim 1, further comprising a maintenance device that performs maintenance on the ejection nozzle groups of the recording head, wherein when the non-ejection status detection device detects one or more ejection nozzles in a non-ejection state in all the plurality of ejection nozzle groups, the maintenance device performs maintenance on all the ejection nozzle groups.

5. The ink-jet recording apparatus according to claim 1, wherein one of the ejection nozzle groups includes ejection nozzles for basic color inks, while another of the ejection nozzle groups includes ejection nozzles for another colors of ink which are different from the basic color inks for the one of the ejection nozzle groups.

6. The ink-jet recording apparatus according to claim 5, wherein one of the ejection nozzle groups includes ejection nozzles for black ink, cyan ink, magenta ink and yellow ink, while another of the ejection nozzle groups includes ejection nozzles for red ink, green ink, blue ink and photo black ink.

7. The ink-jet recording apparatus according to claim 1, wherein one of the ejection nozzle groups includes ejection nozzles for black ink, while another of the ejection nozzle groups includes ejection nozzles for color inks which can generate black color.

8. The ink-jet recording apparatus according to claim 7, wherein one of the ejection nozzle groups includes ejection nozzles for black ink, while another of the ejection nozzle groups includes ejection nozzles for cyan ink, magenta ink and yellow ink.

9. The ink-jet recording apparatus according to claim 7, wherein one of the ejection nozzle groups includes ejection nozzles for black ink, while another of the ejection nozzle groups includes ejection nozzles for red ink, green ink and blue ink.

10. The ink-jet recording apparatus according to claim 1 further comprising: n ink tanks that respectively store n colors of basic color inks; m (m>n) sub-tanks that can be connected to the ink tanks; and a supplying device that supplies the basic color inks from the ink tanks to the sub-tanks.

11. The ink-jet recording apparatus according to claim 10, wherein a plurality of radial openings are provided in the respective sub-tanks at a portion from which the basic color inks are supplied by the supplying device, the plurality of radial openings being formed such that the basic color inks supplied from the ink tanks are dispersed into the sub-tanks.

12. An ink-jet recording apparatus comprising:

a plurality of sub-tanks configured to store a plurality of colors of ink;

a recording head comprising a plurality of ejection nozzle groups, wherein each of the plurality of ejection nozzle groups comprise a plurality of ink ejection portions, and each of the ink ejection portions comprises a plurality of ejection nozzles which are configured to selectively eject one of the plurality of colors of ink inside a respective one of the sub-tanks to a recording medium, wherein each of the plurality of ejection nozzle groups comprise at least one ejection nozzle configured to eject a black ink, and at least one ejection nozzle configured to eject a non-black ink;

an image recording control device configured to select a first one of the plurality of ejection nozzle groups for image recording onto the recording medium; and a non-ejection status detection device configured to detect whether any the plurality of ejection nozzles in the first one of the plurality of ejection nozzle groups is in a non-ejection state, wherein when one of the plurality of ejection nozzles in the first one of the plurality of ejection nozzle groups is in the non-ejection state, the image recording control device deselects the first one of the plurality of ejection nozzle groups from image recording and selects a second one of the plurality of ejection nozzle groups for image recording, wherein the second one of the plurality of ejection nozzle groups does not include any of the plurality of ejection nozzles which are in the first one of the plurality of ejection nozzle groups.

13. An ink-jet recording apparatus comprising:

a plurality of sub-tanks configured to store a plurality of colors of ink;

a recording head comprising a plurality of ejection nozzle groups, wherein each of the plurality of ejection nozzle groups comprise a plurality of ink ejection portions, and each of the ink ejection portions comprises a plurality of ink ejection nozzles which are configured to selectively eject one of the plurality of colors of ink inside a respective one of the sub-tanks to a recording medium;

an image recording control device configured to select a first one of the plurality of ejection nozzle groups for image recording onto the recording medium; and a non-ejection status detection device configured to detect whether any the plurality of ejection nozzles in the first one of the plurality of ejection nozzle groups is in a non-ejection state, wherein when during image recording the non-ejection status detection device detects that one of the plurality of ejection nozzles in the first one of the plurality of ejection nozzle groups is in the non-ejection state, the image recording control device deselects the first one of the plurality of ejection nozzle groups from image recording and selects a second one of the plurality of ejection nozzle groups for image recording, wherein the second one of the plurality of ejection nozzle groups does not include any of the plurality of ejection nozzles which are in the first one of the plurality of ejection nozzle groups.

14. The ink-jet recording apparatus according to claim 1, wherein each of the ejection nozzle groups comprises a plurality of rows of the ejection nozzles for respective colors of ink.

* * * * *